US006806635B1

(12) United States Patent
Ono

(10) Patent No.: US 6,806,635 B1
(45) Date of Patent: Oct. 19, 2004

(54) FE-NI-CR- BASED ALLOY STRIP HAVING IMPROVED PRESS-FORMABILITY AND USED FOR ELECTRODE OF ELECTRON GUN

(75) Inventor: Toshiyuki Ono, Kanagawa (JP)

(73) Assignee: Nippon Mining and Metals Co., Ltd., Tokyo (JP)

( * ) Notice: Subject to any disclaimer, the term of this patent is extended or adjusted under 35 U.S.C. 154(b) by 712 days.

(21) Appl. No.: 09/672,976

(22) Filed: Sep. 29, 2000

(30) Foreign Application Priority Data

Sep. 29, 1999 (JP) ..... 11-276806

(51) Int. Cl.[7] ..... H01J 29/00; H01J 29/46; C22C 38/40

(52) U.S. Cl. ..... 313/458; 313/409; 313/441; 148/327; 420/97

(58) Field of Search ..... 148/327; 420/38, 420/97; 313/458, 441, 409, 410

(56) References Cited

U.S. PATENT DOCUMENTS 5,453,138 A * 9/1995 Inoue et al. ..... 148/308

FOREIGN PATENT DOCUMENTS

| | | |
|---|---|---|
| EP | 0174196 | 3/1986 |
| JP | 08092691 A | 4/1996 |
| JP | 10030157 A | 2/1998 |
| JP | 11106873 A | 4/1999 |

* cited by examiner

*Primary Examiner*—Nimeshkumar D. Patel
*Assistant Examiner*—Thelma Sheree Clove
(74) *Attorney, Agent, or Firm*—Birch, Stewart, Kolasch & Birch, LLP

(57) ABSTRACT

The Fe—Ni—Cr based alloy strip having improved press-formability is provided. The alloy strip essentially consists of from 15 to 20% of Cr, from 9 to 15% of Ni, the balance being Fe and unavoidable impurities, has 0.03% or less of cleanliness as stipulated under JIS G 0555, has final annealed temper and a preferred orientation texture in terms of 50% or less of degree of preferred orientation of the (111) plane in a central portion between the sheet surfaces which is expressed by the following formula:

$$\alpha_{c(111)}=[I_{c(111)}/\{I_{c(111)}+I_{c(200)}+I_{c(220)}+I_{c(311)}\}]\times 100(\%),$$

with the proviso $I_{c(hkl)}$ is the integral X-ray diffraction intensity of the (hkl) plane.

6 Claims, 2 Drawing Sheets

FE-NI-CR- BASED ALLOY STRIP HAVING IMPROVED PRESS-FORMABILITY AND USED FOR ELECTRODE OF ELECTRON GUN

BACKGROUND OF INVENTION

1. Field of Invention

The present invention relates to an alloy, more particularly, an Fe—Ni—Cr alloy used for the electrode of an electron gun. More particularly, the present invention relates to an Fe—Cr—Ni based alloy exhibiting improved drawing formability and non-magnetism required for such electrode.

2. Description of Related Art

The material which is generally used for the electrode of an electron gun mounted in a color Braun tube and the like is Fe—Cr—Ni based alloy material. This is non-magnetic stainless steel and is from approximately 0.05 to 0.7 mm of sheet thickness.

The electrongun is a component of the shadow-mask type color Braun tube.

FIG. 1 is a cross-sectional drawing of the shadow-mask type color Braun tube.

FIG. 2 shows an elevational view and a cross-sectional view of the punched part of the electron gun.

Referring to FIG. 1, the fluorescent coating 2, which emits light of the primary colors, i.e., red, green and blue, is applied on the panel 1. The electron beam 3 is emitted from the electron gun 4 provided in the neck portion, and is deflected and scanned by the deflecting yoke 5. The shadow mask is denoted by 6. The magnetic shield is denoted by 7. These parts 1–7 are all known.

In FIG. 2, an example of the formed parts of an electron gun is denoted by 10. The electron beams for light emitting either red, green or blue color pass through the apertures 10*a* of the part 10. The minute apertures 10 a can be formed by subjecting an Fe—Cr—Ni based alloy to press-drawing to form a predetermined shape and then punching it to pierce the apertures.

Several techniques for improving the press formability of Fe—Cr—Ni alloy material are proposed in the following Japanese Patent Applications. It is proposed in Japanese Unexamined Patent Publication (kokai) No. 8-92,691 (Japanese Patent Application No. 6-257253) to facilitate the press drawing, as particularly barring by means of modifying the rolling reduction of area and annealing conditions of the alloy material. The barring works to form an aperture through a strip and to extrude a punch through the aperture so as to widen the aperture. Low-viscosity oil facilitates the detergent operation and hence enhances the press formability. Japanese Unexamined Patent Publication No. 10-30,157 (Japanese Patent Application 8-205,453) relates to such press forming and proposes to measure the central line of surface roughness of the blank material and then to specify the average thickness with respect to the central line and also the maximum roughness so as to further enhance the press formability. According to Japanese Unexamined Patent Publication No. 11-106,873 (Japanese Patent Application No. 9-283,039), an appropriate amount of S is added to ensure the blanking formability and to control trace components to enhance the drawability. This invention is based on a discovery that the burrs left upon press-blanking are related to cracking during the barring.

In recent years, since Braun tubes used for a computer have become more and more miniaturized and luminous, higher level of focusing performance required of the Braun tube. This, in turn, leads to the requirements that the material used for the electron gun has such improved formability as to be capable of forming a large lens diameter with high accuracy and to cope with the increase in the press-forming speed. Under such circumstances, since cracks are formed on the drawn surface 10*b* (c.f. FIG. 2) of the conventional Fe—Cr—Ni based alloy material, such material cannot meet fully the requirements mentioned above.

SUMMARY OF INVENTION

It is an object of the present invention to provide improved alloy material for producing the electrode of an electron gun, which can meet the requirements for drawability, particularly the post-drawing surface quality which has become higher in recent years.

The present inventors discovered that the drawability of Fe—Cr—Ni based alloy material varies depending upon the degree of preferred orientation of such material, which has been finally annealed, and the distribution of preferred orientation along the direction across the sheet surfaces. More specifically, the drawability is poor when the degree of preferred orientation of the (111) plane is high in the central portion between the sheet surfaces. The draw ability is also poor, when the degree of preferred orientation of the (111) plane is higher on the surfaces of a sheet than in the central portion of the material.

The degree of the preferred orientation of the (111) plane in the central portion between the sheet surfaces of material is expressed by the following formula $\alpha_{c(111)}$ $$\alpha_{c(111)}=[I_{c(111)}/\{I_{c(111)}+I_{c(200)}+I_{c(220)}+I_{c(311)}\}]\times 100(\%)$$

In this formula, $I_{(hkl)}$ is the integral intensity of diffraction peaks of the (hkl) planes in the central portion between the surfaces of a sheet.

The degree of preferred orientation of the (111) plane on the surface portion of the material is expressed by the following formula $\alpha_{s(111)}$ $$\alpha c(\mathbf{111})=[I_{c(111)}/\{I_{s(111)}+I_{s(200)}+I_{s(220)}+I_{s(311)}\}]\times 100(\%)$$

In this formula, $I_{s(hkl)}$ is the integral intensity of diffraction peaks of the (hkl) planes on the surface portion of a sheet.

In the Fe—Ni—Cr based alloy material used for the electrode of an electron gun, the degree of preferred orientation of the (111) plane is specified based on the above discovery. In accordance with the present invention there is provided the following Fe—Ni—Cr based alloy strips used for the electrode of an electron gun.

(1) An Fe—Ni—Cr based alloy strip having sheet surfaces, essentially consisting of from 15 of 20% of Cr, from 9 to 15% of Ni, the balance being Fe and unavoidable impurities, such percentages being -based on weight, having 0.03% or less of cleanliness as stipulated under JIS G 0555, having final annealed temper and a preferred orientation texture in terms of 50% or less of degree of preferred orientation of the (111) plane in the central portion between the sheet surfaces which is expressed by the following formula:

$$\alpha_{c(111)}=[I_{c(111)}/\{I_{c(200)}+I_{c(200)}+I_{c(220)}+I_{(311)}\}]\times 100(\%)$$

In this formula, $I_{c(hkl)}$ is the integral intensity of diffraction peaks of the (hkl) planes in the central portion between the surfaces of a sheet.

(2) An Fe—Ni—Cr based alloy strip having sheet surfaces, essentially consisting of from 15 to 20% of Cr, from 9 to 15% of Ni, the balance being Fe and unavoidable impurities, such percentages being based on weight, having 0.03% or less of cleanliness stipulated under JIS G 0555, having final annealed temper and a preferred orientation texture in terms of 50% or less of the $\alpha_{c(111)}$, which is equal to or greater than $\alpha_{s(111)}$ which indicates the degree of preferred orientation of the (111) plane on the surface portion of the material, i.e., $\alpha_{s(111)} \leqq \alpha_{c(111)}$.

In accordance with the present invention, there is also provided the electrode of an electron gun, consisting of the Fe—Cr—Ni alloys (1) or (2), mentioned above.

DESCRIPTION OF PREFERRED EMBODIMENTS

Figure 1:
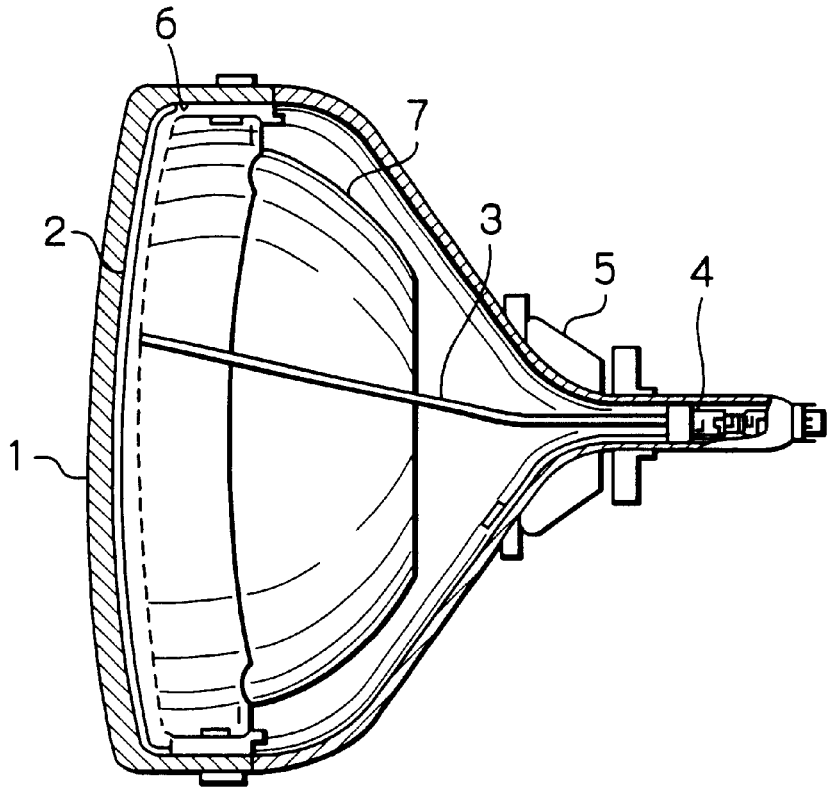
Fig. 1 PRIOR ART
FIG. 1 is a cross-sectional tube of a color Braun tube.
Figure 2:
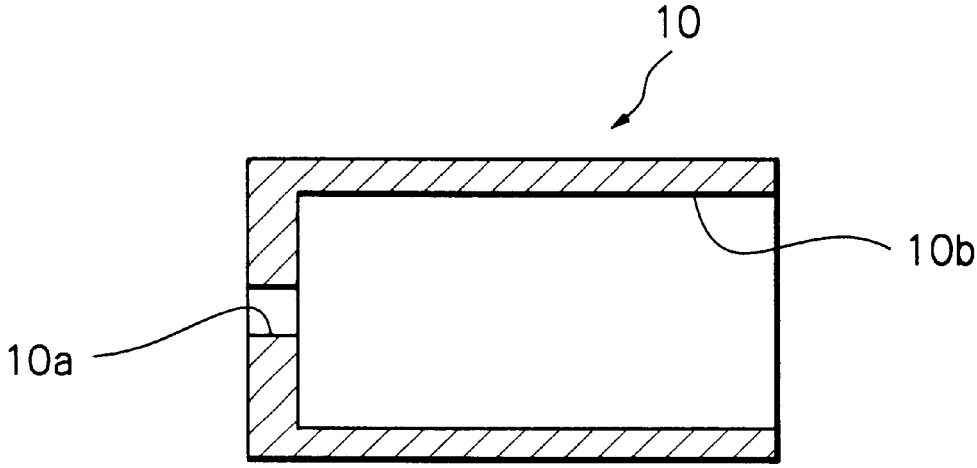
Fig. 2 PRIOR ART
FIG. 2 is a longitudinal cross-sectional view of the drawn parts of an electrongun.

First, the components of the Fe—Ni—Cr based alloy strip according to the present invention are described.

Cr: Non-magnetic properties are required for the electrode of an electron gun. Usually, the non-magnetic properties must be 1.005 or less in terms of permeability. Cr content of from 15 to 20% attains such permeability. The more preferred range of Cr content is from 15 to 17%.

N: When Ni is less than 9%, the permeability is excessive. When the Ni content is more than 15%, the cost of the raw materials is increased. The Ni content is, therefore, from 9 to 15%.

The balance of the above components is Fe and unavoidable impurities. It is preferred to limit the upper limits of C, P, O, N, Ca, Mg, Ti, Nb, V and Zr among the unavoidable impurities as follows.

C: When C is more than 0.12%, carbides are formed in substantial amount such as to impair the drawability. The C content is, therefore, preferably 0.12% or less.

P: When P is more than 0.03%, the drawability is seriously impaired. The P content is, therefore, preferably 0.03% or less.

O (oxygen): When the O content is high, the oxide inclusions become excessive such that the drawability is impaired. The O content is, therefore, preferably 0.005% or less.

N: When the N content exceeds 0.1%, the formability is impaired. The N content is, therefore, preferably 0.1% or less.

Ca: Ca forms sulfides and oxides, which impair the drawability. The Ca content is, therefore, preferably 0.05% or less. A preferable Ca content is 0.01% or less.

Mg: Mg forms oxides, which impair the drawability. The Mg content is, therefore, preferably 0.02% or less. A more preferable Mg content is 0.005% or less.

Ti: Ti forms carbides; sulfides, oxides and nitrides, which impair the drawability. The Ti content is, therefore, preferably 0.1% or less. A more preferable Ti content is 0.02% or less.

Nb: Nb forms carbides, sulfides, oxides and nitrides, which impair the drawability. The Nb content is, therefore, preferably 0.1% or less. A more preferable Nb content is 0.02% or less.

V: V forms carbides, oxides and nitrides, which impair the drawability. The V content is, therefore, preferably 0.1% or less. A more preferable V content is 0.02% or less.

Zr: Zr forms oxides, which impair the drawability. The Zr content is, therefore, 0.1% or less. A more preferable Zr content is 0.02% or less.

These components can be suppressed to less than the preferable levels by means of strictly selecting the raw materials.

Besides those components, the Fe—Cr—Ni based alloy material according to the present invention can contain the following optional elements. The elements listed below directly or indirectly improve the non-magnetic properties and the press formability. Alternatively, they may not impair the press formability but may improve the other required properties.

Si: Si is added for the deoxidizing purpose. When the Si content is less than 0.005%, the deoxidizing effects are not realized. On the other hand, when the Si content is more than 1.0%, the formability is impaired. The Si content is, therefore, preferably from 0.005 to 1.0%.

Mn: Mn is added for the deoxidizing purpose and for precipitating MnS. When the Mn content is less than 0.005%, these purposes are not realized. On the other hand, when the Mn content is more than 2.5%, the material hardness is so increased that the drawability is impaired. The Mn content is, therefore, from 0.005 to 2.5%.

S: S is added in an appropriate amount and with Mn forms MnS. This formation leads to suppression of burr formation during press-punching an aperture and, in turn, to prevention of cracking during the barring. However, when the S content is less than 0.0003%, these effects are not attained. On the other hand, when the S content is more than 0.0100%, coarse MnS is formed and the drawability is impaired. The S content is, therefore, preferably from 0.0003 to 0.0100%.

Mo: Since Mo improves corrosion resistance, Mo is preferably added when corrosion resistance is especially desired. However, when the Mo content is more than 2.0%, the drawability is impaired. The Mo content is, therefore, preferably 2.0% or less.

Al: Al is added as a deoxidizing agent. When the Al content is less than 0.001%, the deoxidizing effects are not satisfactory. On the other hand, when the Al content is more than 0.2%, the formability is impaired. The Al content is, therefore, preferably from 0.001 to 0.2%.

The Fe—Cr—Ni based alloy material according to the present invention must have 0.03% or less of cleanliness as stipulated under JIS G 0555. When the cleanliness is more than 0.03%, the drawability, particularly the deep drawability and barring formability, is impaired. This level of cleanliness can be achieved by means of strict selection of the raw materials, and the vacuum-melting and deoxidizing process and the like.

Next, preferred orientation degree of the (111) plane specified in the Fe—Cr—Ni alloy material according to the present invention is described.

The degree of preferred orientation of the (111) plane in the central portion between the sheet surfaces of the material is expressed as $\alpha_{c(111)}$. When $\alpha m_{c(111)}$ is more than 50%, the plastic anisotropy is increased to such a level that the drawing deformation of the material occurs unevenly. The $\alpha_{c(111)}$ is, therefore, set as 50% or less.

The degree of preferred orientation of the (111) plane on the sheet surfaces of the material is expressed as $\alpha_{s(111)}$. When $\alpha_{s(111)}$ is more than $\alpha_{c(111)}$, the drawability is impaired even if $\alpha_{c(111)}$ is 50% or less. Therefore, $\alpha_{s(111)} \leqq \alpha_{c(111)}$.

Now, a method for producing the Fe—Cr—Ni based alloy material according to the present invention is described. In this regard, a conventional method may be used, as long as the ingot-casting, the rough rolling or forging, the continuous casting of a slab, which may replace the ingot casting followed by rough rolling or forging, the peeling, hot-rolling, repeated cold-rolling and annealing, and the softening-annealing of a sheet having the final thickness for enhancing the formability are successively carried out. The final annealed temper is, therefore, such that the alloy material is softening-annealed after it has been rolling-reduced to the final sheet thickness.

The alloy strip is a long material suitable for continuously press-forming the parts of an electron gun. Its width is not particularly limited but is usually from 12 to 120 mm. In the above-mentioned production process, the conditions of cold-rolling and final annealing exert the most influence upon the preferred orientations mentioned above. The present inventors repeated plant experiments and then discovered that the degree of preferred orientation of the (111) plane can be controlled within the above ranges under the following conditions: from 35 to 80% of working degree of cold rolling; from 40 to 120 mm of the cold-rolling-roll diameter; from 0.03 to 0.20 mm of draft per path of cold rolling; and from 50 to 100° C./second of cooling speed after the final annealing down to 400° C.

The present invention is hereinafter described with reference to the examples.

EXAMPLES

Commercial pure iron, electrolytic nickel, electrolytic chromium, scraps of electron-gun parts and the like were charged into a vacuum-melting furnace to provide the compositions shown in Table 1. The raw materials were melted and cast to form the ingots. However, the component A in Table 1 was subjected to aluminum-deoxidizing before the casting, while the component B was cast without deoxidizing. After casting, the rough rolling, peeling, hot-rolling and descaling were carried out in a conventional manner. The cold-rolling and annealing were then repeated. The final annealing was carried out at 1050° C. to produce 0.4 mm-thick annealed sheets. In the inventive examples, the working degree of cold rolling was 65%, the rolling-roll diameter was 75 mm, and, the post-annealing average cooling speed in a temperature range from 1050 to 400° C. was 80° C./second. In the comparative example, the working degree of cold rolling was 32%.

The degree of preferred orientation of the (111) plane was calculated from the X-ray diffraction results using a Co tube as the X-ray source.

Figure 3:
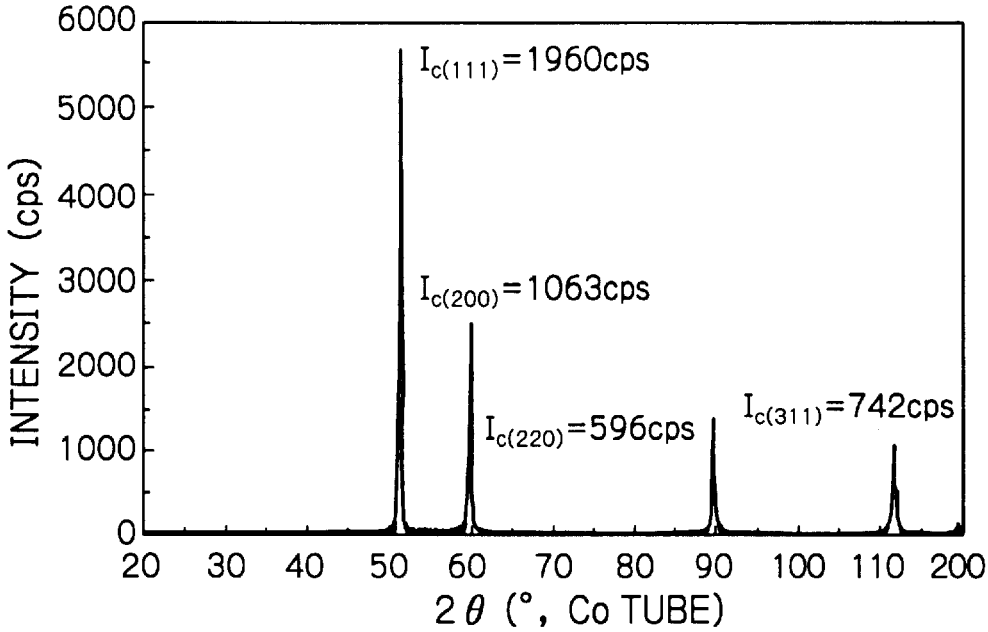
FIG. 3 is an X-ray diffraction profile of the material's central portion between the sheet surfaces.
Figure 4:
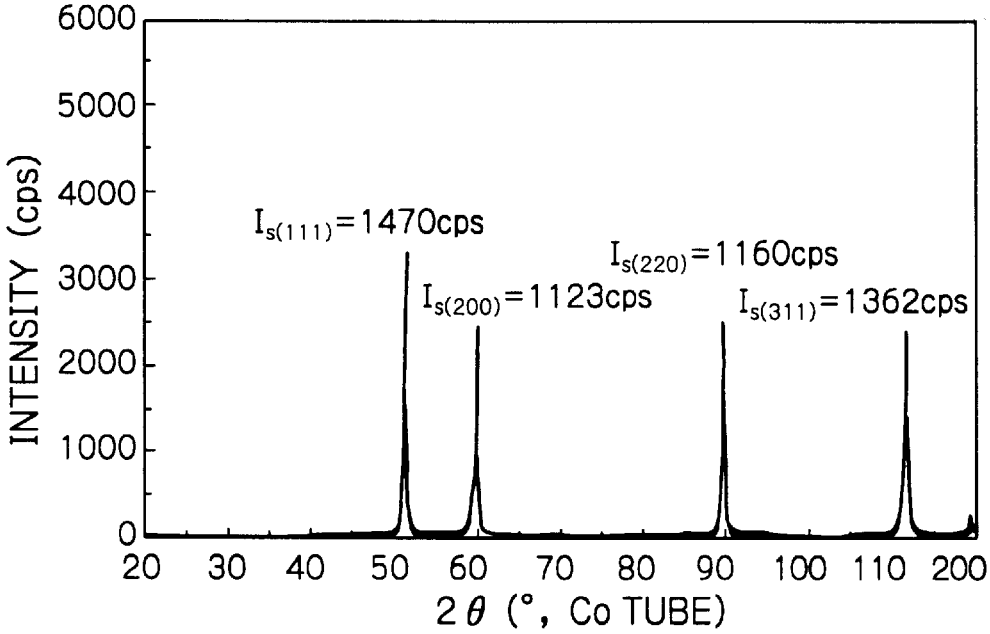
FIG. 4 is an X-ray diffraction profile of the surface portions.

Referring to FIG. 3, the X-ray diffraction image in the central portion between the sheet surfaces is shown with regard to Sample No. 1 in Table 1. Referring to FIG. 4, the X-ray diffraction image on the surface portions is shown with regard to Sample No. 1 in Table 1. The preferred orientation on the surface portions was measured with regard to the material's surface as it was. Meanwhile, the preferred orientation of the central portion was measured by cutting the sheet into halves at the center between the sheet surfaces and measuring the cut and polished surface.

The annealed material was subjected to the deep-drawing test by using water-soluble wax as the lubricant, and the limiting drawing ratio was measured. The drawing was also carried out using a flat punch at 1.33 of the drawing ratio. The evaluation was carried out by observing whether the cracks were formed on the work pieces. In Table 2, the degree of preferred orientation of the (111) plane, the press formability and the cleanliness are shown.

As is apparent from Table 2, the inventive Examples Nos. 1 through 5 has greater limiting drawing ratio and better drawvability than those of the comparative Examples Nos. 6 through 8. The inventive example No. 1 falls within claim 1 with regard to the $\alpha_{c(111)}$ but has $\alpha_{c(111)}$ and $\alpha_{s(111)}$ outside the range of claim 2. The limiting drawing ratio of the inventive example No. 5 is, therefore, smaller than that of the inventive example No. 1, notwithstanding the fact that $\alpha_{c(111)}$ is almost the same. Because $\alpha_{c(111)}$ is more than 50% in the comparative examples Nos. 6 and 7, the limiting drawing ratio is low. In addition, since the cleanliness as stipulated under JIS G 0555 is more than 0.03% in the comparative Sample No. 8, the frequency of crack formation on the drawn parts was high.

TABLE 1

| | (%) | | | | | | | | | | | | | | | | | | |
|---|---|---|---|---|---|---|---|---|---|---|---|---|---|---|---|---|---|---|---|
| | Cr | Ni | C | Si | Mn | P | S | Mo | Al | O | N | Ti | Nb | V | Zr | Ca | Mg | Fe | Remarks |
| Components A | 16.1 | 14.5 | 0.05 | 0.6 | 1.5 | 0.022 | 0.0026 | 0.01 | 0.004 | 0.0022 | 0.036 | 0.002 | 0.002 | 0.001 | 0.001 | 0.001 | 0.001 | bal | Inventive |
| Components B | 16.5 | 14.2 | 0.06 | 0.5 | 1.5 | 0.023 | 0.0026 | 0.01 | 0.001 | 0.0052 | 0.039 | 0.003 | 0.002 | 0.001 | 0.002 | 0.002 | 0.001 | bal | Comparative |

TABLE 2

| | | | Degree of Preferred Orientation of (111) (%) | | Press Formability | | Cleanliness |
|---|---|---|---|---|---|---|---|
| | No. | Component | $\alpha_{c(111)}$ | $\alpha_{s(111)}$ | Limiting Drawing Ratio | Cracks on Drawn Portions | (%) |
| Inventive Example | 1 | Component A | 44.9 | 42.5 | 2.32 | none | 0.016 |
| | 2 | Component A | 42.5 | 39.4 | 2.38 | none | 0.016 |
| | 3 | Component A | 32.1 | 30.5 | 2.41 | none | 0.016 |
| | 4 | Component A | 28.7 | 28.2 | 2.41 | none | 0.016 |
| | 5 | Component A | 45.9 | 52.2 | 2.26 | none | 0.016 |

TABLE 2-continued

| | No. | Component | Degree of Preferred Orientation of (111) (%) $\alpha_{c(111)}$ | $\alpha_{s(111)}$ | Press Formability Limiting Drawing Ratio | Cracks on Drawn Portions | Cleanliness (%) |
|---|---|---|---|---|---|---|---|
| Comparative Example | 6 | Component A | 52.7 | 48.9 | 2.15 | none | 0.016 |
| | 7 | Component A | 55.7 | 51.2 | 2.15 | none | 0.016 |
| | 8 | Component B | 52.4 | 55.3 | 2.01 | present (numerous) | 0.037 |

What is claimed is:

1. An Fe—Ni—Cr based alloy strip having sheet surfaces, essentially consisting of from 15 to 20% of Cr, from 9 to 15% of Ni, the balance being Fe and unavoidable impurities, such percentages being based, on weight, having 0.03% or less of cleanliness as stipulated under JIS G 0555, having final annealed temper and a preferred orientation texture in terms of 50% or less of degree of preferred orientation of the (111) plane in a central portion between the sheet surfaces which is expressed by the following formula:

$$\alpha_{c(111)}=[I_{c(111)}/\{I_{c(111)}+I_{c(200)}+I_{c(220)}+I_{c(311)}\}]\times 100(\%),$$

with the proviso $I_{c(hkl)}$ is the integral X-ray diffraction intensity of the (hkl) plane.

2. An Fe—Cr—Ni based alloy strip according to claim 1, wherein it has a degree of preferred orientation of the (111) plane on the surface portion of the material $\alpha_{s(111)}$ equal to or less than said $\alpha_{c(111)}$, i.e., $\alpha_{s(111)} \leqq \alpha_{(111)}$.

3. An Fe—Cr—Ni based alloy strip according, to claim 1 or 2, which further contains one or more of the elements selected to from the group consisting of: 0.12% or less of C, 0.03% or less of P, 0.005% or less of O, 0.1% or less of N, 0.05% or less of Ca, 0.02% or less of Mg, 0.1%, or less of Ti, 0.1% or less of Nb, 0.1% of V, 0.1% or less of Zr, from 0.005 to 2.5%, from 0.0003 to 0.0100% of S, 2.0% or less of Mo, and 0.001 to 0.2% or less of Al.

4. An electrode of an electron gun formed by deep drawing and barring of a sheet, which sheet consists of an Fe—Ni—Cr based alloy, which alloy essentially consists of from 15 to 20% of Cr, from 9 to 15% of Ni; the balance being Fe and unavoidable impurities, such percentages being based on weight; has 0.03% or less of cleanliness as stipulated under JIS G 0555; has final annealed temper and a preferred orientation texture in terms of 50% or less of degree of preferred orientation of the (111) plane in a central portion between the sheet surfaces which is expressed by the following formula:

$$\alpha_{c(111)}=[I_{c(111)}/\{I_{c(111)}+I_{c(200)}+I_{c(220)}+I_{c(311)}\}]\times 100(\%),$$

with the proviso $I_{c(hkl)}$ is integral X-ray diffraction intensity of the (hkl) plane.

5. An electrode according to claim 1, wherein: said Fe—Cr—Ni alloy has a degree of preferred orientation of the (111) plane on the surface portion of the material $\alpha_{s(111)}$ equal to or less than said $\alpha_{c(111)}$, i.e. $\alpha_{s(111)} \leqq \alpha_{c(111)}$.

6. An electrode according to claim 4 or 5, said Fe—Cr—Ni alloy further contains one or more of the elements selected to from the group consisted of: 0.12% or less of C, 0.03% or less of P, 0.005% or less of O, 0.1% or less of N, 0.05% or less of Ca, 0.02% or less of Mg, 0.1% or less of Ti, 0.1% or less of Nb, 0.1% of V, 0.1% or less of Zr, from 0.005 to 2.5from 0.0003 to 0.0100% of S, 2.0% or less of Mo, and 0.001 to 0.2% or less of Al.

* * * * *